US010024325B2

(12) United States Patent
Phillips et al.

(10) Patent No.: US 10,024,325 B2
(45) Date of Patent: Jul. 17, 2018

(54) PUMP USING MULTI VOLTAGE ELECTRONICS WITH RUN DRY AND OVER CURRENT PROTECTION

(71) Applicant: Flow Control LLC, Gloucester, MA (US)

(72) Inventors: David L. Phillips, Santa Ana, CA (US); Humberto V. Meza, Tustin, CA (US); Derrick T. Tran, Yorba Linda, CA (US)

(73) Assignee: Flow Control LLC., Beverly, MA (US)

( * ) Notice: Subject to any disclaimer, the term of this patent is extended or adjusted under 35 U.S.C. 154(b) by 401 days.

(21) Appl. No.: 13/708,075

(22) Filed: Dec. 7, 2012

(65) Prior Publication Data

US 2013/0343907 A1 Dec. 26, 2013

Related U.S. Application Data

(60) Provisional application No. 61/567,960, filed on Dec. 7, 2011.

(51) Int. Cl.

| | |
|---|---|
| ***F04D 15/02*** | (2006.01) |
| ***F04B 17/03*** | (2006.01) |
| ***F04B 49/06*** | (2006.01) |

(52) U.S. Cl.

CPC ..... *F04D 15/0245* (2013.01); *F04B 17/03* (2013.01); *F04B 49/065* (2013.01); (Continued)

(58) Field of Classification Search

CPC ..... H02P 7/00; H02H 3/00; F04B 2205/03; F04B 17/03; F04B 2201/0207

(Continued)

(56) References Cited

U.S. PATENT DOCUMENTS

| | | | |
|---|---|---|---|
| 3,407,739 | A | 10/1968 | Myers |
| 3,953,152 | A | 4/1976 | Sipin |

(Continued)

FOREIGN PATENT DOCUMENTS

| | | |
|---|---|---|
| CN | 1897451 | 1/2007 |
| CN | 201934302 | 8/2011 |

(Continued)

*Primary Examiner* — Thienvu Tran
*Assistant Examiner* — Pinping Sun
(74) *Attorney, Agent, or Firm* — Ware, Fressola, Maguire & Barber LLP

(57) ABSTRACT

A pump has a signal processor, including one forming part of a printed circuit board assembly, that receives signaling containing information about a voltage supplied to a motor to run a particular pump model, and also containing information about whether a current draw of the pump is lower than a predetermined low current level or is higher than a predetermined high current level; and determines whether to shut off the pump after a predetermined time, based on the signaling received. The signal processor provides control signalling to shut off the pump after the predetermined time if the current draw of the pump is lower than the predetermined low current level or is higher than the predetermined high current level, where the predetermined low current level and the predetermined high current level depend on the voltage being supplied to the motor to run the particular pump model.

20 Claims, 4 Drawing Sheets

(52) U.S. Cl.
CPC ..... *F04B 2201/0207* (2013.01); *F04B 2203/0201* (2013.01); *F04B 2203/0202* (2013.01)

(58) Field of Classification Search
USPC ..... 318/455
See application file for complete search history.

(56) References Cited

U.S. PATENT DOCUMENTS

| | | | | |
|---|---|---|---|---|
| 4,221,543 | A | 9/1980 | Cosentino et al. | |
| 4,420,787 | A | 12/1983 | Tibbits et al. | |
| 4,473,856 | A | 9/1984 | Takahashi et al. | |
| 4,841,404 | A | 6/1989 | Marshall et al. | |
| 5,076,761 | A | 12/1991 | Krohn et al. | |
| 5,076,763 | A | 12/1991 | Asastos et al. | |
| 5,577,890 | A | 11/1996 | Nielsen et al. | |
| 6,227,806 | B1 | 5/2001 | Libfeld | |
| 6,280,170 | B1 | 8/2001 | Furuya et al. | |
| 6,390,780 | B1 | 5/2002 | Batchelder et al. | |
| 6,414,455 | B1 | 7/2002 | Watson | |
| 6,481,973 | B1 | 11/2002 | Struthers | |
| 6,534,940 | B2 * | 3/2003 | Bell | B63J 4/006 318/430 |
| 6,625,519 | B2 | 9/2003 | Goodwin et al. | |
| 6,675,989 | B1 | 1/2004 | Ritter et al. | |
| 6,798,162 | B2 * | 9/2004 | Makaran | H02M 1/10 318/108 |
| 6,873,131 | B1 | 3/2005 | Watkins | |
| 6,998,807 | B2 * | 2/2006 | Phillips et al. | 318/455 |
| 7,080,508 | B2 | 7/2006 | Stavale et al. | |
| 7,191,067 | B1 * | 3/2007 | Berry | E21B 43/128 702/9 |
| 7,352,550 | B2 * | 4/2008 | Mladenik et al. | 361/87 |
| 7,393,185 | B2 | 7/2008 | Scanderbeg et al. | |
| 7,407,371 | B2 | 8/2008 | Leone et al. | |
| 7,442,014 | B1 | 10/2008 | Mellinger et al. | |
| 7,690,897 | B2 | 4/2010 | Branecky et al. | |
| 7,821,215 | B2 | 10/2010 | Koehl | |
| 7,966,168 | B2 * | 6/2011 | Elvis | H02P 5/00 703/18 |
| 2002/0176782 | A1 | 11/2002 | Batchelder et al. | |
| 2004/0088797 | A1 | 5/2004 | Darby | |
| 2004/0213676 | A1 | 10/2004 | Phillips et al. | |
| 2004/0265135 | A1 | 12/2004 | Carboneri et al. | |
| 2006/0130504 | A1 * | 6/2006 | Agrawal | F25B 49/02 62/228.4 |
| 2006/0164773 | A1 | 7/2006 | Stanford et al. | |
| 2007/0284609 | A1 * | 12/2007 | Ang | G11C 5/145 257/139 |
| 2008/0018112 | A1 | 1/2008 | Kleen | |
| 2009/0064698 | A1 | 3/2009 | Spanger | |
| 2009/0119036 | A1 * | 5/2009 | Jayanth | F04B 49/065 702/60 |
| 2010/0237161 | A1 | 9/2010 | Sandahl | |
| 2011/0110794 | A1 * | 5/2011 | Mayleben | F04B 23/021 417/53 |
| 2011/0255992 | A1 * | 10/2011 | Tran et al. | 417/1 |
| 2011/0293450 | A1 * | 12/2011 | Grimes | F04B 53/16 417/420 |
| 2012/0213644 | A1 * | 8/2012 | Phillips | B67D 1/0004 417/1 |

FOREIGN PATENT DOCUMENTS

| | | | | |
|---|---|---|---|---|
| EP | 1255174 | | 11/2002 | |
| EP | 0909380 | B1 * | 2/2005 | G01M 13/045 |
| EP | 1914427 | | 4/2008 | |
| EP | 2246569 | | 11/2010 | |
| EP | 2262073 | | 12/2010 | |
| WO | WO 9749977 | A1 * | 12/1997 | G01M 13/045 |
| WO | 2004098012 | | 11/2004 | |
| WO | 2009108467 | | 9/2009 | |

* cited by examiner

PUMP USING MULTI VOLTAGE ELECTRONICS WITH RUN DRY AND OVER CURRENT PROTECTION

CROSS-REFERENCE TO RELATED APPLICATIONS

This application claims benefit to provisional patent application Ser. No. 61/567,960 (911-012.023-1//F-JAB-1104), filed 7 Dec. 2011, which is incorporated by reference in its entirety.

BACKGROUND OF THE INVENTION

1. Field of Invention

The present invention relates to a pump; and more particularly to a pump using multi voltage electronics for providing run dry and over current protection to a particular pump model.

2. Description of Related Art

Most pumps in the markets are usually voltage specific with motors for each voltage. When the pump is running and the fluid is exhausted, there is either a float switch/level switch to shut the pump off that is externally mounted to a container or tank, or the pump simply continues to run until it is damaged or shut off manually.

Some shortcomings of these known pump designs include the fact that multiple pump models are required for different voltages. Moreover, when the pumps run dry, they are often damaged and require maintenance.

SUMMARY OF THE INVENTION

In summary, by utilizing an electronic printed circuit board assembly (PCBA) internal to a pump, one is able to accept 12/24/(possibly 32V+ as well) VDC as well as utilize an external wall mounted power supply to convert 115/230 VAC to run one pump model. The PCBA may also contain software features and controller functionality that protect against run dry and over current situations to protect not only the electronics but the pump as a whole.

By way of example, and according to some embodiments, the present invention may include, or take the form of, apparatus such as a pump featuring a signal processor, including where the signal processor forms part of a printed circuit board assembly (PCBA), configured to:

- receive signaling containing information about a voltage being supplied to a motor to run a particular pump model, and also containing information about whether a current draw of the pump is lower than a predetermined low current level or is higher than a predetermined high current level; and
- determine whether to shut off the pump after a predetermined time, based at least partly on the signaling received.

The signal processor, including the PCBA, may also be configured to provide control signalling to shut off the pump after the predetermined time if the current draw of the pump is lower than the predetermined low current level or is higher than the predetermined high current level, where the predetermined low current level and the predetermined high current level depend on the voltage being supplied to the motor to run the particular pump model.

The present invention may include one or more of the following features:

The signal processor, including the PCBA, may be configured to provide control signalling to shut off the pump after the predetermined time if the current draw of the pump is lower than the predetermined low current level or is higher than the predetermined high current level, where the predetermined low current level and the predetermined high current level depend on the voltage being supplied to the motor to run the particular pump model.

The signal processor, including the PCBA, may be configured to provide the control signalling to shut the pump off in order to protect the pump against a run dry and/or over current conditions of the pump.

The control signalling may include blinking a rocker lamp if the current draw of the pump is either lower than the predetermined low current level or higher than the predetermined high current level.

The signal processor, including the PCBA, may be configured, programmed or adapted to run on the particular pump model having one input voltage, and may also be configured, programmed or adapted to run on a different particular pump model having a different input voltage. For example, the signal processor, including the PCBA, may be configured with a respective software routine for each particular pump model, and implement the appropriate software routine based at least partly on the voltage being supplied to the motor to run the particular pump model. In effect, the PCBA may be configured universally to run on numerous pump models.

The particular pump model forms part of a series of pumps having different voltage requirements, including a 12 volt pump, a 24 volt pump, or a 32 volt pump, etc. In the series of pumps, each particular pump model has a respective motor having a corresponding voltage requirement.

The pump may contain the PCBA inside its housing.

The Method

The present invention may also take the form of a method including steps for receive signaling containing information about a voltage being supplied to a motor to run a particular pump model, and also containing information about whether a current draw of the pump is lower than a predetermined low current level or is higher than a predetermined high current level; and determining whether to shut off the pump after a predetermined time, based at least partly on the signaling received.

The method may also include providing control signalling to shut off the pump after the predetermined time if the current draw of the pump is lower than the predetermined low current level or is higher than the predetermined high current level, where the predetermined low current level and the predetermined high current level depend on the voltage being supplied to the motor to run the particular pump model, as well as one or more of the other features set forth above.

BRIEF DESCRIPTION OF THE DRAWING

The drawing includes FIGS. 1-4, which are not necessarily drawn to scale, as follows.

DETAILED DESCRIPTION OF BEST MODE OF THE INVENTION

Figure 1:
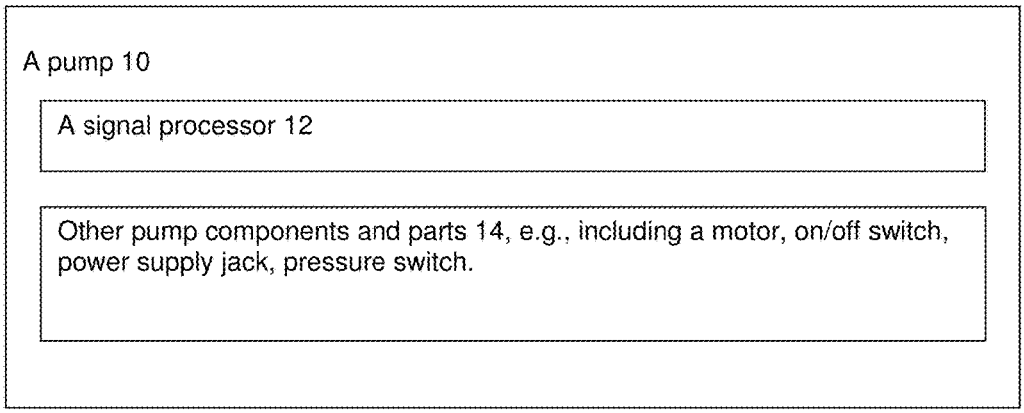
FIG. 1 is a block diagram of pump, according to some embodiments of the present invention.

FIG. 1: The Basic Pump 10

By way of example, FIG. 1 shows the present invention in the form of a pump generally indicated as 10 that includes a signal processor, including where the signal processor forms part of a printed circuit board assembly (PCBA) 12, configured to receive signaling containing information about a voltage being supplied to a motor to run a particular pump model, and also containing information about whether a current draw of the pump is lower than a predetermined low current level or is higher than a predetermined high current level; and determine whether to shut off the pump after a predetermined time, based at least partly on the signaling received.

Figure 2:
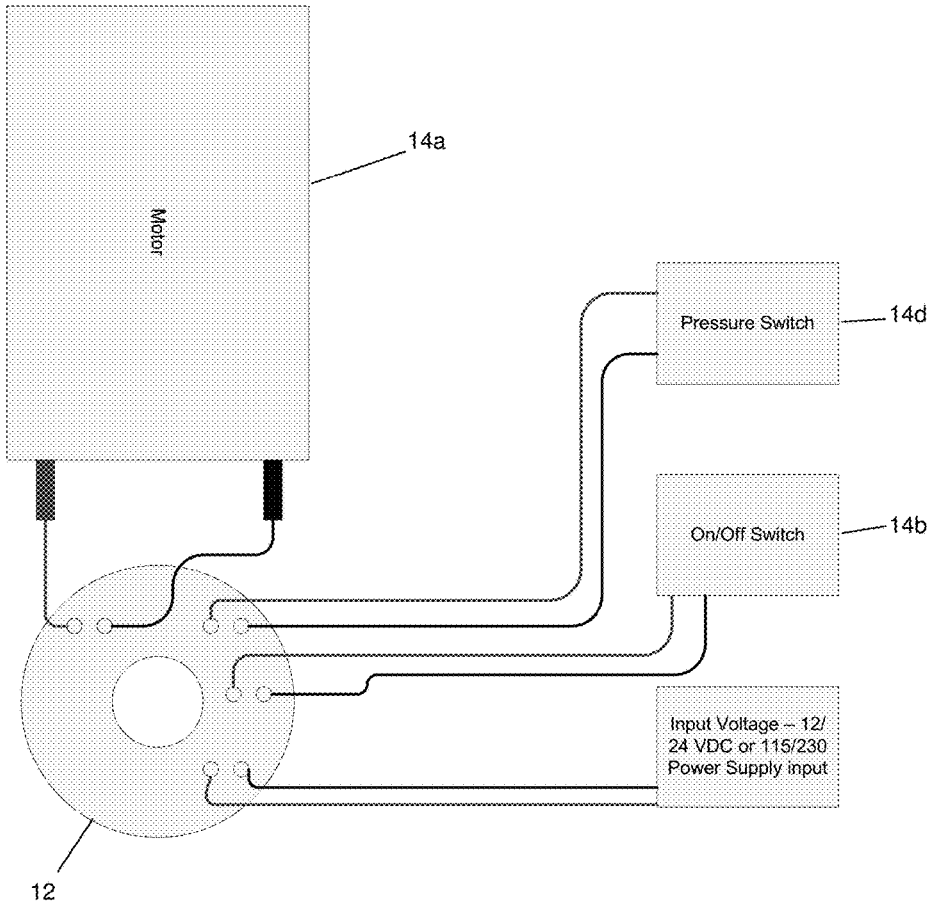
FIG. 2 is a block diagram of components that form part of a pump, according to some embodiments of the present invention.
Figure 3:
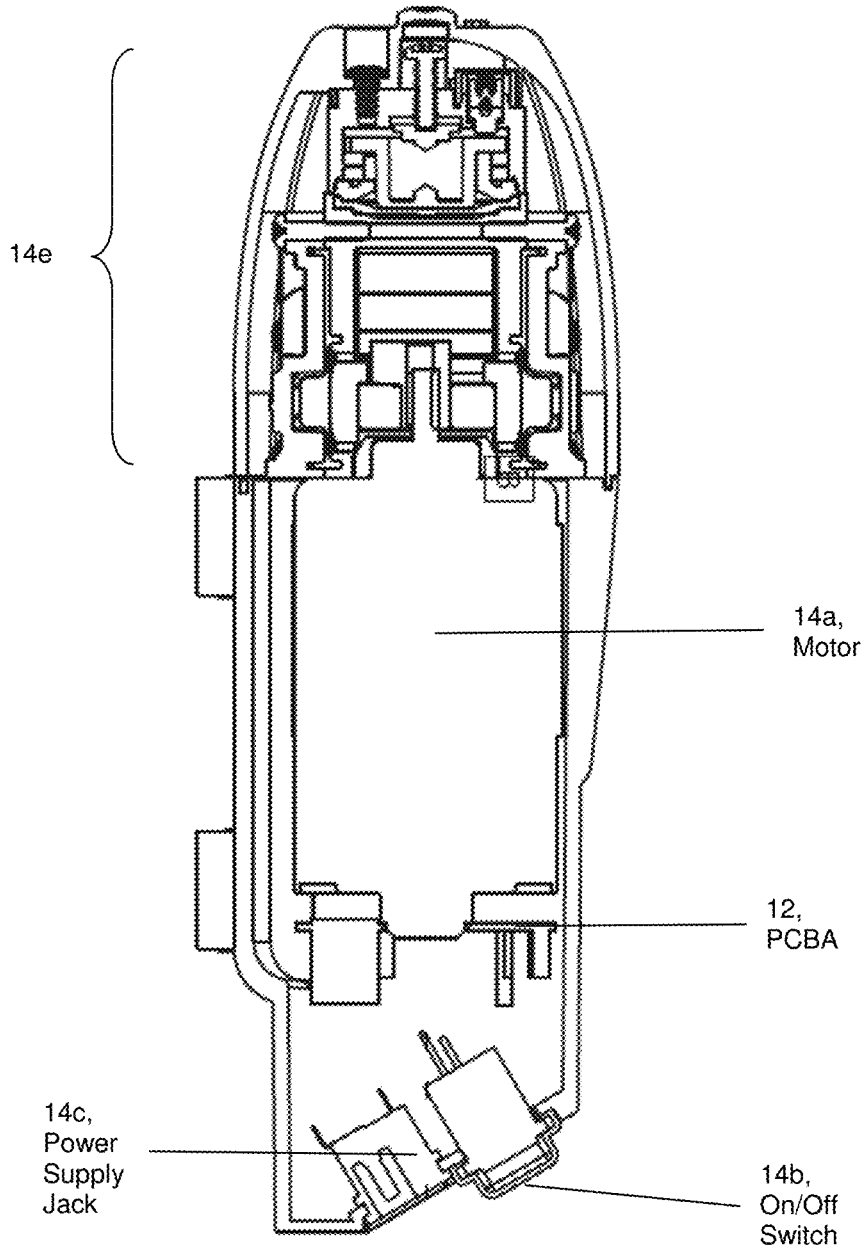
FIG. 3 is a cross sectional view of a pump, according to some embodiments of the present invention.

The pump 10 may also include other pump components and parts generally indicated as 14 in FIG. 1 that do not form part of the underlying invention, e.g., including a motor 14*a*, on/off switch 14*b*, a power supply jack 14*c*, a pressure switch 14*d* and a front end pumping portion 14*e*, as shown in FIGS. 2 and 3. The power supply jack 14*c* is configured for receiving or accepting 12/24/(possibly 32V+ as well) VDC as well as utilize an external wall mounted power supply to convert 115/230 VAC to run one pump model. The pressure switches like element 14*d* are known in the art, may be configured to sense the pressure of fluid being pumped, and provide corresponding signaling, e.g. to turn off the pump if the sensed pressure exceeds some predetermined pumping pressure. Front end pumping portion like element generally indicated as element 14*e* may be configured for pumping the fluid or liquid of interest by the pump 10 and are known in the art, such that the scope of the invention is not intended to be limited to any particular type, kind or configuration of the same.

The signal processor, including the PCBA 12, may be configured to provide control signalling to shut off the pump 10 after the predetermined time, e.g., if the current draw of the pump 10 is lower than the predetermined low current level or is higher than the predetermined high current level, where the predetermined low current level and the predetermined high current level depend on the voltage being supplied to the motor 14*a* (FIG. 2) to run the particular pump model. For example, the control signalling may contain information for turning or switching off the motor 14*a*.

Figure 4:
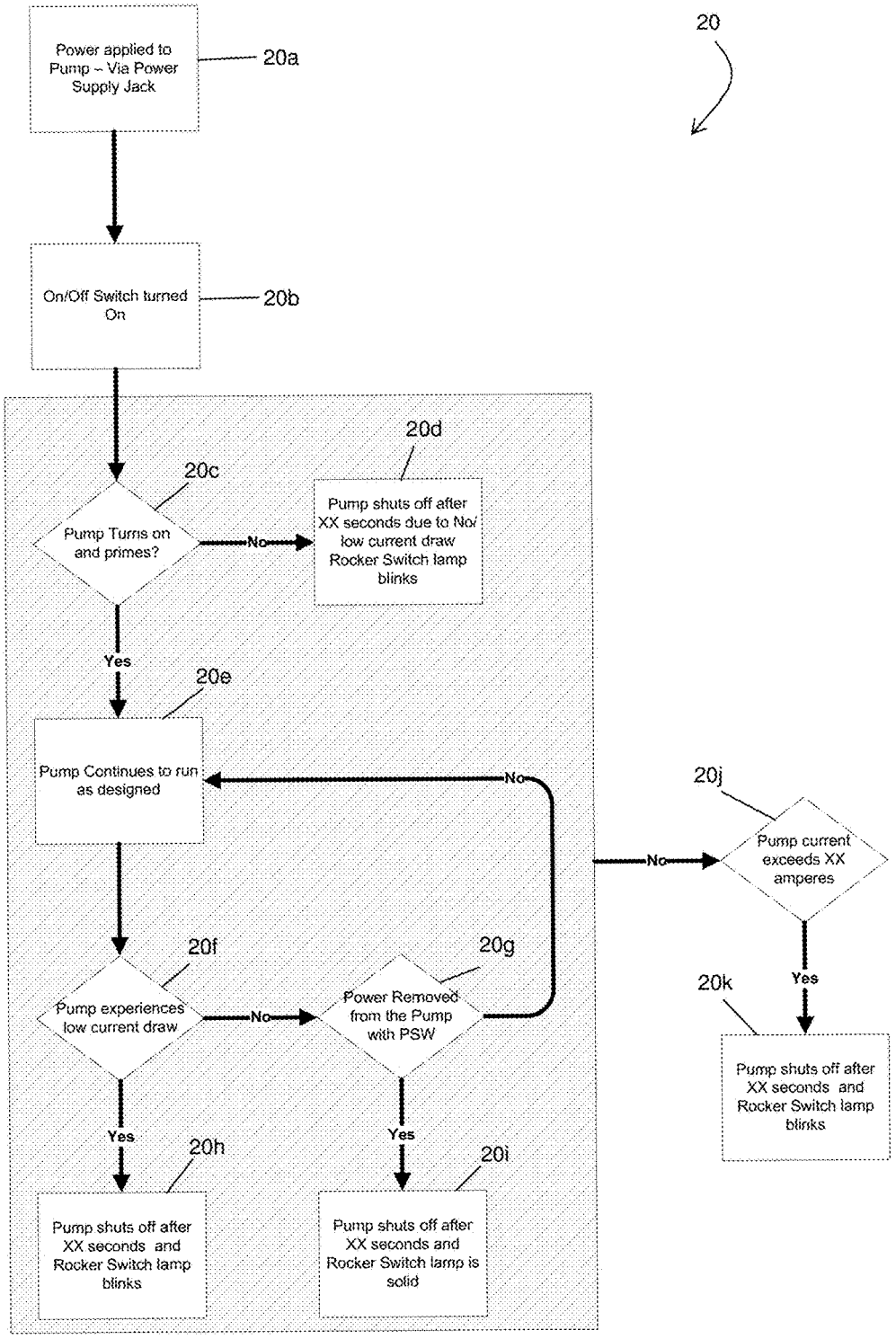
FIG. 4 is a block diagram of a flowchart for providing run dry and over current protection, according to some embodiments of the present invention.

The signal processor, including the PCBA 12, may be configured to provide the control signalling to shut the pump 10 off in order to protect the pump 10 against a run dry and/or over current conditions of the pump, consistent with the pump control routine generally indicated as 20 shown in FIG. 4. For example, see steps 20*d*, 20*h* and 20*k*.

The control signalling may include blinking a rocker lamp when if the current draw of the pump is either lower than the predetermined low current level or higher than the predetermined high current level, consistent with the pump control routine 20 shown in FIG. 4. Again, see the steps 20*d*, 20*h* and 20*k*. The control signalling may include turning a rocker lamp solid when power is removed from the pump 10. See steps 20*g* and 20*i*.

The signal processor, including the PCBA 12, may be configured and programmed to run on the particular pump model having one input voltage, and may also be configured, programmed and/or suitably to run on a different particular pump model having a different input voltage for running a pump motor.

The signal processor, including the PCBA 12, may be configured with at least one processor and at least one memory including computer program code, the at least one memory and computer program code configured, with the at least one processor, to cause the signal processor to receive the signaling containing information about the voltage being supplied to the motor to run the particular pump model, and also containing information about whether the current draw of the pump is lower than the predetermined low current level or is higher than the predetermined high current level; and determine whether to shut off the pump after the predetermined time, based at least partly on the signaling received.

The present invention may also take the form of a method including steps for receive signaling containing information about a voltage being supplied to a motor such as 14*a* (FIG. 2) to run a particular pump model, and also containing information about whether a current draw of the pump 10 is lower than a predetermined low current level or is higher than a predetermined high current level; and determining whether to shut off the pump after a predetermined time, based at least partly on the signaling received.

By way of example, the direct current voltage may be in a range of about 12-32 volts; and the alternating current voltage may be in a corresponding range of about 115/230 volts, although the scope of the invention is not intended to be limited to any particular voltage or voltage range.

Signal Processor 12

By way of example, and consistent with that described herein, the functionality of the signal processor, device or module and/or PCBA 12 may be implemented to receive the signaling, process the signaling therein and/or provide the control signaling, using hardware, software, firmware, or a combination thereof, although the scope of the invention is not intended to be limited to any particular embodiment thereof. In a typical software implementation, the signal processor, including the PCBA 12, may include, or take the form of, one or more microprocessor-based architectures having a microprocessor, a random access memory (RAM), a read only memory (ROM), input/output devices and control, data and address busing architecture connecting the same. A person skilled in the art would be able to program such a microprocessor-based implementation to perform the functionality set forth herein, as well as other functionality described herein without undue experimentation. The scope of the invention is not intended to be limited to any particular implementation using technology either now known or later developed in the future. Moreover, the scope of the invention is intended to include a signal processor as either part of the aforementioned apparatus, as a stand alone module, or in the combination with other circuitry for implementing another module.

Techniques for receiving signaling in such a signal processor, device, module or PCBA like element 12 are known in the art, and the scope of the invention is not intended to be limited to any particular type or kind thereof either now known or later developed in the future. Based on this understanding, a person skilled in the art would appreciate, understand and be able to implement and/or adapt the signal processor, device, module or PCBA like element 12 without undue experimentation so as to receive the signaling containing information about a voltage being supplied to a motor to run a particular pump model, and also containing information about whether a current draw of the pump is lower than a predetermined low current level or is higher than a predetermined high current level, consistent with that set forth herein.

Techniques for determining signaling from other signaling are also known in the art, and the scope of the invention is not intended to be limited to any particular type or kind thereof either now known or later developed in the future. Based on this understanding, a person skilled in the art would appreciate, understand and be able to implement and/or adapt the signal processor, device, module or PCBA like element 12 without undue experimentation so as to determine whether to shut off the pump after a predetermined time, based at least partly on the signaling received.

Techniques for providing signaling a signal processor such as element 12 are also known in the art, and the scope of the invention is not intended to be limited to any particular type or kind thereof either now known or later developed in the future. Based on this understanding, a person skilled in the art would appreciate, understand and be able to implement and/or adapt the signal processor, device, module or PCBA like 12 without undue experimentation so as to provide control signalling to shut off the pump after the predetermined time if the current draw of the pump is lower than the predetermined low current level or is higher than the predetermined high current level, where the predetermined low current level and the predetermined high current level depend on the voltage being supplied to the motor to run the particular pump model, consistent with that set forth herein.

It is also understood that the apparatus 10 may include one or more other modules, components, processing circuits, or circuitry 14 for implementing other functionality associated with the underlying apparatus that does not form part of the underlying invention, and thus is not described in detail herein. By way of example, the one or more other modules, components, processing circuits, or circuitry may include random access memory, read only memory, input/output circuitry and data and address buses for use in relation to implementing the signal processing functionality of the signal processor, or devices or components, etc.

FIG. 4 The Method

FIG. 4 shows a flowchart generally indicated as 20 having steps 20*a*, 20*b*, 20*c*, . . . , 20*j* and 20*k* for operating the pump 10, including for providing run dry and over current protection controller functionality, according to some embodiments of the present invention. In addition to the controller functionality set forth in FIG. 4, the signal processor, including the PCBA 12, may be configured to execute a time out in order to turn the pump off, e.g., including in order to prevent the pump from emptying a container or reservoir of liquid if there should be any leaks in the system as a whole. By way of example, the executed time out feature may take the form of a predetermined time out, e.g., which may be set at 5 minutes and can be set for anytime, that is a safety feature to prevent the pump from emptying the container or reservoir of a fluid. The executed time out feature may also be used as a safety shutoff in general. Based on the flowchart in FIG. 4 and steps 20*a*, 20*b*, 20*c*, . . . , 20*j* and 20*k* set forth therein, a person skilled in the art would understand, appreciate and be able to program the signal processor, including the PCBA 12, with a computer program to implement the control functionality to run the particular pump model according to the present invention.

Applications

The present invention may also be used in, or form part of, or used in conjunction with, any fluid handling application. The scope of the invention is also not intended to be limited to being implemented in any particular type or kind of pump either now known or later developed in the future, and may include diaphragm pumps, positive displacement pumps, etc.

The Scope of the Invention

While the invention has been described with reference to an exemplary embodiment, it will be understood by those skilled in the art that various changes may be made and equivalents may be substituted for elements thereof without departing from the scope of the invention. In addition, may modifications may be made to adapt a particular situation or material to the teachings of the invention without departing from the essential scope thereof. Therefore, it is intended that the invention not be limited to the particular embodiment(s) disclosed herein as the best mode contemplated for carrying out this invention.

What is claimed is:

1. A pump forming a part of a series of pumps having different motors with different voltage requirements, comprising:

a signal processor configured to form a part of a printed circuit board assembly (PCBA), configured to:

receive signaling containing information about a voltage being supplied to a motor to run a particular pump model forming the part of a series of the pumps having different motors with different voltage requirements, information about whether a current draw of the pump is lower than a first predetermined current level and information about whether the current draw of the pump is higher than a second predetermined current level, determine corresponding signaling containing information whether to shut off the pump after a predetermined time, based at least partly on the signaling received; and determine further corresponding signaling containing information whether to execute a time out to shut off the pump for a further predetermined amount of time; and the PCBA being configured with a respective software routine for each particular pump model in the series of the pumps, and also configured to implement an appropriate software routine based upon on the voltage being supplied to the motor to run each particular pump model so as universally to run on numerous pump models;

wherein the first predetermined current level and the second predetermined current level depend on the voltage being supplied to the motor to run the particular pump model.

2. A pump according to claim 1, wherein the PCBA is configured to provide the corresponding signaling containing information whether to shut off the pump after the predetermined time as control signaling to shut off the pump after the predetermined time if the current draw of the pump is lower than the first predetermined current level or is higher than the second predetermined current level, where the first predetermined current level and the second predetermined current level depend on the voltage being supplied to the motor to run the particular pump model.

3. A pump according to claim 2, wherein the PCBA is configured to provide the control signaling to shut the pump off in order to protect the pump against a run dry condition and/or an over current condition of the pump.

4. A pump according to claim 2, wherein the control signaling may include blinking a rocker lamp if the current draw of the pump is either lower than the first predetermined current level or higher than the second predetermined current level.

5. A pump according to claim 1, wherein the PCBA is configured, programmed or adapted to run on the particular pump model having one input voltage, or also be configured, programmed or adapted to run on a different particular pump model having a different input voltage.

6. A pump according to claim 1, wherein the particular pump model forms the part of the series of the pumps having different voltage requirements, including at least a 12 volt pump and a 24 volt pump.

7. A pump according to claim 6, wherein the series of the pumps includes each particular pump model having a respective motor having a corresponding voltage requirement.

8. A pump according to claim 1, wherein the pump contains a housing, and the PCBA is configured to be inside the housing.

9. A pump according to claim 1, wherein the PCBA is configured with at least one processor and at least one memory including a computer program code, the at least one memory and the computer program code configured, with the at least one processor, to cause the PCBA to:

receive the signaling containing information about the voltage being supplied to the motor to run the particular pump model, and also containing information about whether the current draw of the pump is lower than the first predetermined current level or is higher than the second predetermined current level; and determine whether to shut off the pump after the predetermined time, based at least partly on the signaling received; and to implement the appropriate software routine based upon on the voltage being supplied to the motor to run the particular pump model and also universally to run on the numerous pump models.

10. A pump according to claim 1, wherein the pump comprises a wall mounted power supply configured to provide the voltage being supplied to the motor to run the particular pump model.

11. A method for controlling a pump forming a part of a series of pumps having different motors with different voltage requirements, comprising:

receiving in a signal processor configured to form a part of a printed circuit board assembly (PCBA) signaling containing information about a voltage being supplied to a motor to run a particular pump model forming the part of the series of the pumps having different motors with different voltage requirements, and whether a current draw of the pump is lower than a first predetermined current level and whether the current draw of the pump is higher than a second predetermined current level;

determining corresponding signaling containing information whether to shut off the pump after a predetermined time, based at least partly on the signaling received;

determining further corresponding signaling containing information whether to execute a time out to shut off the pump for a further predetermined amount of time;

configuring the PCBA with a respective software routine for each particular pump model forming the part of the series of the pumps, and implementing an appropriate software routine based upon on the voltage being supplied to the motor to run the particular pump model so as universally to run on numerous pump models;

wherein the first predetermined current level and the second predetermined current level depend on the voltage being supplied to the motor to run the particular pump model.

12. A method according to claim 11, wherein the method comprises providing with the PCBA the corresponding signaling as control signaling to shut off the pump after the predetermined time if the current draw of the pump is lower than the first predetermined current level or is higher than the second predetermined current level, where the first predetermined current level and the second predetermined current level depend on the voltage being supplied to the motor to run the particular pump model.

13. A method according to claim 12, wherein the method comprises providing with the PCBA the control signaling to shut the pump off in order to protect the pump against a run dry condition and/or an over current condition of the pump.

14. A method according to claim 12, wherein the control signaling may include blinking a rocker lamp if the current draw of the pump is either lower than the first predetermined current level or higher than the second predetermined current level.

15. A method according to claim 11, wherein the method comprises configuring, programming or adapting the PCBA to run on the particular pump model having one input voltage, or also be configured, programmed or adapted to run on a different particular pump model having a different input voltage.

16. A method according to claim 11, wherein the particular pump model forms the part of the series of the pumps having different voltage requirements, including at least a 12 volt pump and a 24 volt pump.

17. A method according to claim 16, wherein the series of the pumps includes each particular pump model having a respective motor having a corresponding voltage requirement.

18. A method according to claim 11, wherein the method comprises configuring the pump with a housing, and arranging the PCBA inside the housing.

19. A method according to claim 11, wherein the method comprises configuring the PCBA with at least one processor and at least one memory including computer program code; and causing the at least one memory and the computer program code configured, with the at least one processor, to:

receive the signaling containing information about the voltage being supplied to the motor to run the particular pump model, and also containing information about whether the current draw of the pump is lower than the first predetermined current level or is higher than the second predetermined current level; and determine whether to shut off the pump after the predetermined time, based at least partly on the signaling received; and to implement the appropriate software routine based upon on the voltage being supplied to the motor to run the particular pump model and also universally to run on the numerous pump models.

20. A method according to claim 11, wherein the method comprises providing with a wall mounted power supply the voltage being supplied to the motor to run the particular pump model.

* * * * *